United States Patent [19]

Fuerst

[11] Patent Number: 4,897,936

[45] Date of Patent: Feb. 6, 1990

[54] SHOE SOLE CONSTRUCTION

[75] Inventor: Rory W. Fuerst, Menlo Park, Calif.

[73] Assignee: Kaepa, Inc., San Antonio, Tex.

[21] Appl. No.: 156,176

[22] Filed: Feb. 16, 1988

[51] Int. Cl.[4] ..... A43B 13/12; A43B 13/04; A43B 13/18; A43B 5/00

[52] U.S. Cl. ..... 36/30 A; 36/31; 36/32 R; 36/59 R; 36/114; D2/320

[58] Field of Search ..... 36/30 A, 30 R, 31, 32 R, 36/25, 28, 59 R, 59 A, 59 C, 114; 128/586; D2/319, 320

[56] References Cited

U.S. PATENT DOCUMENTS

| | | | |
|---|---|---|---|
| D. 290,660 | 7/1987 | Selbiger | D2/320 |
| 2,101,761 | 12/1937 | Stagl | 128/586 |
| 4,266,349 | 5/1981 | Schmohl | 36/32 R |
| 4,316,335 | 2/1982 | Giese et al. | 36/32 R |
| 4,680,875 | 7/1987 | Danieli | 36/31 |

FOREIGN PATENT DOCUMENTS

| | | | |
|---|---|---|---|
| 2113143 | 10/1972 | Fed. Rep. of Germany | 36/32 R |
| 2458576 | 6/1976 | Fed. Rep. of Germany | 36/114 |
| 3035706 | 6/1982 | Fed. Rep. of Germany | 36/32 R |
| 2457652 | 12/1980 | France | 36/59 R |
| 2553636 | 4/1985 | France | 36/25 R |

*Primary Examiner*—James Kee Chi

*Attorney, Agent, or Firm*—Cohn, Powell & Hind

[57] ABSTRACT

The shoe sole (12) includes an insole (18), an outsole (16) and a midsole (20). The outsole includes openings (28, 30) at the ball of the foot and the heel of the foot and the midsole, of EVA material, is provided with cavities (46, 48) receiving polyurethane inserts (50, 52) disposed concentrically with respect to associated outsole openings. The inserts are larger in diameter than the outside openings and include a domed central portion (58) projecting through said openings.

14 Claims, 2 Drawing Sheets

FIG. 4.
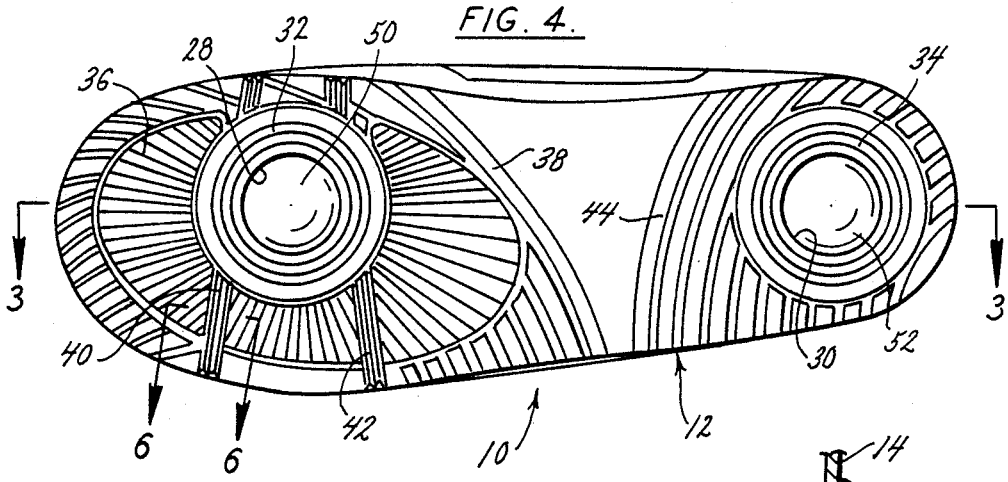
FIG. 5.
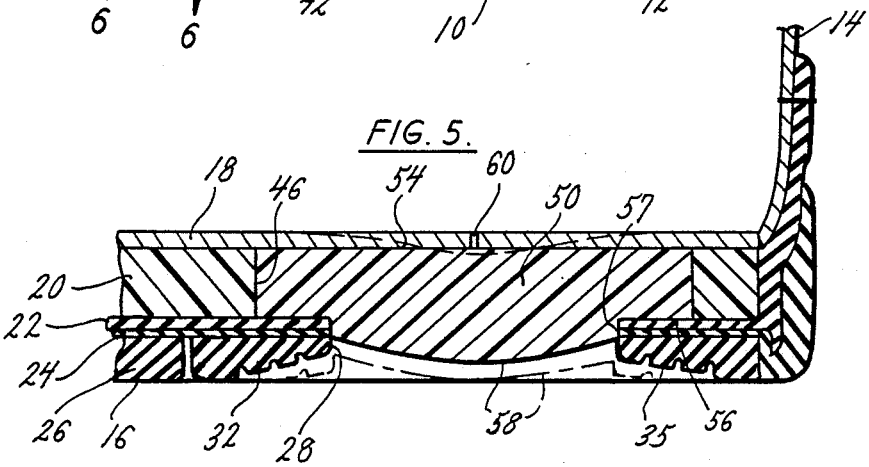
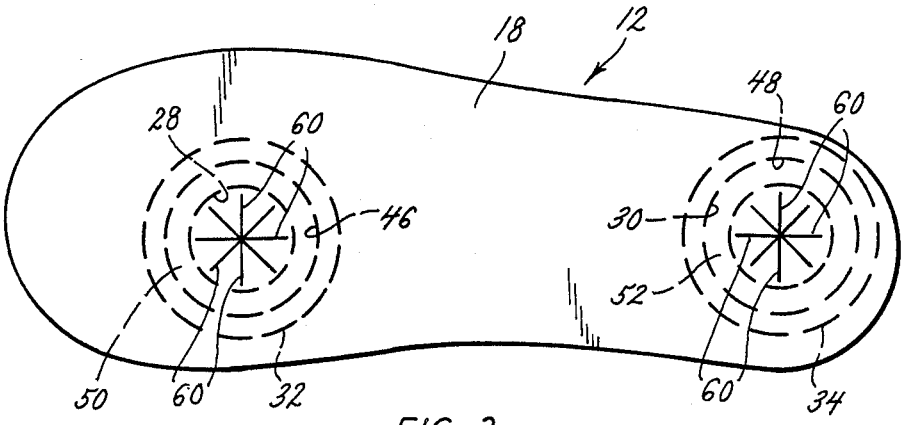
FIG. 2.

SHOE SOLE CONSTRUCTION

BACKGROUND OF THE INVENTION:

This invention relates generally to athletic shoes and more specifically to a cushioned shoe sole construction.

Athletic shoes of the type under consideration are constantly being improved both with respect to the fit of the uppers and the cushioning and slip resistant features of the sole. It is most important that proper cushion be provided in view of the extreme physical demands made on the feet of players of this most active sport.

Cushioning as currently provided on athletic shoes takes many forms. For example U.S. Pat. No. 4,449,307 discloses a basketball shoe having a cellular midsole which is one approach to the problem but is expensive. Other approaches include forming the entire midsole of polyurethane cushioning material as opposed to the more common and more easily workable Ethylene Vinyl Acetate (EVA). Several manufacturers have utilized a construction which includes an insert of polyurethane cushioning material located within the midsole at the ball of the foot and sometimes at the heel of the foot. This material is inserted between the insole and the outsole and is covered by the outsole tread with the result that full advantage is not taken of the superior cushioning quality of polyurethane. Thus, in this construction the outsole extends beneath the insert which reduces the cushioning effect at these critical points.

The present invention solves these and other problems in a manner not disclosed by the known prior art.

SUMMARY OF THE INVENTION:

This shoe sole is particularly adapted for use with athletic shoes for basketball, tennis and allied sports and provides superior cushioning for the foot of the athlete.

The sole uses different cushioning materials at selected locations of the foot having a structure to enhance the cushioning effect at these locations, for example the ball of the foot and the heel of the foot.

It is an aspect of this invention to provide an outsole including a portion located at the ball of the foot and the portion located at the heel of the foot, at least one of said portions including an opening, and a midsole cushioning portion sandwiched between said insole and said outsole and including at least one cavity of a size greater than the outsole opening and being generally concentric with said outsole opening, and to provide an insert disposed within the opening of the midsole portion, said insert being of a size substantially the same as the size of the midsole cavity, said insert having a central portion substantially the same size as, and generally concentric with, said outsole opening and projecting through said opening and said insert having an annular portion overlapping said outsole opening.

It is an aspect of this invention to provide that the outsole includes a reinforcing ring coaxial with the outsole opening and greater in size than said insert.

Yet another aspect of this invention is to provide that the outsole reinforcing rings include an inwardly and upwardly inclined lower face.

It is another aspect of this invention to provide that said insert central portion is substantially dome-shaped having a dome height such that said central portion is not ground engaging in normal play but engages the ground under appropriate player weight distribution conditions.

It is still another aspect of this invention to provide that the insert includes a stepped portion adjacent said domed portion tending to retain said insert in place.

It is yet another aspect of this invention to provide that the insole is of pressboard and the portion of said insole above said insert axis includes a plurality of radiating slits.

It is another object of this invention to provide that the outsole includes openings and that associated inserts are located under the ball of the foot and also under the heel of the foot.

It is an aspect of this invention to provide that the insert located under the heel of the foot is substantially thicker than the insert located at the ball of the foot.

It is an aspect of this invention to provide that the insert material is polyurethane; another aspect to provide that the midsole material is EVA and another aspect to provide that the insole is pressboard.

It is an aspect of this invention to provide a shoe sole which is relatively inexpensive to manufacture and is effective for providing superior cushioning.

BRIEF DESCRIPTION OF THE DRAWINGS:

FIG. 2 is a plan view of the insole;

FIG. 4 is a plan view of the outsole of the shoe;

FIG. 5 is an enlarged cross section taken on line 5—5 of FIG. 2.

Figure 1:
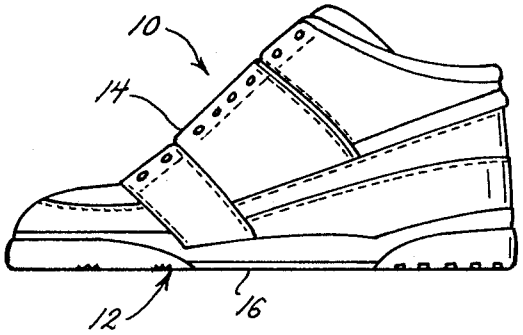
FIG. 1 is a fragmentary elevational view of a right shoe.
Figure 6:
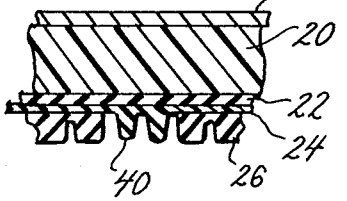
FIG. 6 is a cross-sectional view taken on line 6—6 of FIG. 3.
Figure 3:
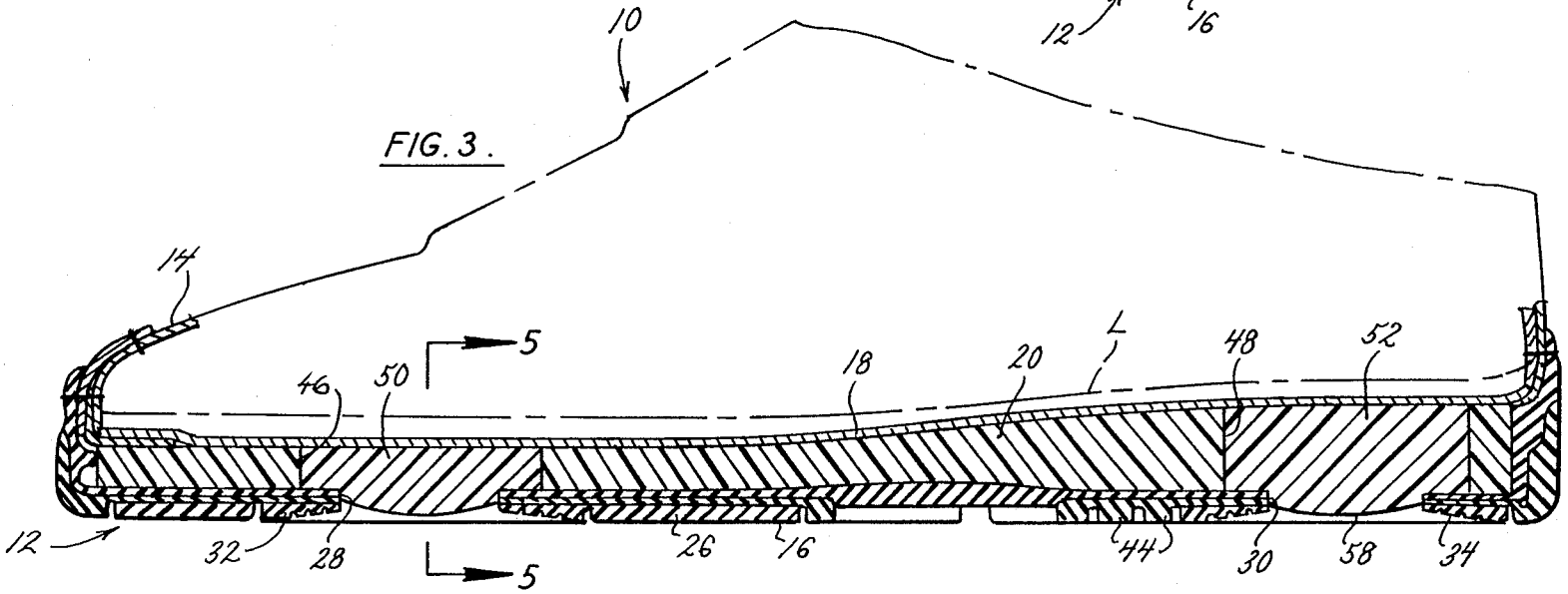
FIG. 3 is a fragmentary longitudinal section taken on line 3—3 of FIG. 2.

DESCRIPTION OF THE PREFERRED EMBODIMENT:

Referring now by reference numerals to the drawings and first to FIG. 1 it will be understood that the shoe 10 of the embodiment shown is a basketball shoe having a sole 12 and uppers 14. The uppers 14 are of the high top variety and can be of a conventional design or a split vamp design manufactured by Kaepa, Inc. and similar to that shown in U.S. Pat. No. 3,546,796.

The sole 12 includes an outsole portion 16, insole portion 18 and a midsole cushioning portion 20 formed of EVA. In the embodiment shown the outsole portion 16 is of basic rubber compound formed from a molded laminate having a relatively thin inner layer 22, an intermediate layer 24 which provides a color contrast and a relatively thick tread portion 26. The outsole portion 16 includes a circular opening 28 in the vicinity of the ball of the foot under the great toe and a circular opening 30 in the vicinity of the heel. In the embodiment shown the outsole tread portion 26 includes ribbed rings 32 and 34 which are concentrically formed about associated openings 28 and 30 respectively and each has an inwardly and upwardly inclined lower face 35. The outsole tread portion 26 also includes, disposed about the toe ring 32, a set of generally radial ribs generally indicated by numeral 36, curved ribs 38 and flex bar ribs 40 and 42 interrupting said radial ribs, said ribs cooperating with each other to provide the sole 12 with lateral stability. Curved ribs 44 are disposed about the heel ring 32.

As best shown in FIG. 5 the midsole cushioning portion 20 includes circular cavities 46 and 48 concentrically formed with outsole openings 28 and 30 respectively having a diameter greater than the diameter of the associated outsole openings 28 but less than the diameter of the associated ribbed rings. In the embodiment shown inserts 50 and 52 respectively are disposed within each cavity 46 and 48. These inserts are of thermoset polyurethane foam which has high tear and tensile strength compared with EVA and superior cushioning and are generally diametrically similar to each other in size but the heel insert 52 is substantially thicker than the toe insert 50. The inserts will therefore be described with reference to the toe insert 50 it being understood that the description applies equally to the heel insert 52.

The insert 50 snugly interfits the cavity 48 and includes a circular upper face 54 and a lower face which is defined by an annular portion 56, a stepped portion 57 having a height substantially that of the combined thickness of outsole layers 22 and 24, acting to locate and retain the insert in place within the outsole openings during manufacture and a dome-shaped central portion 58 of generally spherical configuration. Because of this structural arrangement of parts, the annular portion 56 overlaps the outer sole opening 28 and is thereby supported by the margin portion of said opening including said ribbed ring 32. The dome-shaped portion 58 has a height less than the thickness of the outer sole and does not engage the floor or ground until sufficient weight is applied to it by the weight of the player, at which time it will assume the configuration shown in phantom outline in FIG. 5. Also, the lower face 35 of the ring 32 tends to flatten out and engage the floor to provide greater peripheral support. This arrangement provides a superior cushioning effect at these two locations in particular without resulting in excessive wear of the skin of the polyurethane insert lower surface.

The insole portion 18 is of pressboard, cardboard or similar flexible material and is glued to the midsole upper surface. As shown particularly in FIG. 2, the area of the insole portion 18 disposed immediately above the inserts 50 and 52 includes a plurality of cuts 60, eight (8) in number in the embodiment shown, which radiate outwardly from the axis of the openings. These cuts are effective to ensure that a high quality glue connection will be made in the vicinity of the insert and also provide a flexible zone which tends to be readily depressed to increase the sensitivity of the foot to the special cushioning effect of the insert. If desired a removable sock liner, indicated by L, can be disposed above the insole.

Having described the invention in detail, those skilled in the art will appreciate that modifications may be made without departing from its spirit. For example, although the inserts and related openings have been shown as generally circular they could be elliptical or other appropriate shape. Therefore, it is not intended that the scope of the invention be limited to the specific embodiments illustrated and described. Rather, it is intended that the scope of this invention be determined by the appended claims and their equivalents.

I claim as my invention:

1. A shoe sole comprising:

(a) an insole, (b) an outsole including a portion located at the ball of the foot and a portion located at the heel of the foot including an opening in at least one of said portions, said outsole having a ground-engaging surface, (c) a midsole cushioning portion sandwiched between said insole and said outsole and including at least one cavity opening of a size greater than the outsole opening and being generally concentric with said outsole opening, and (d) an insert is disposed within the cavity opening of the midsole portion, said insert having an outer portion of a size substantially the same as the size of the midsole cavity opening, said insert having an inner central portion substantially the same size as, and generally concentric with said outsole portion opening and projecting into said opening but not beyond the outsole ground-engaging surface and having an annular portion overlapping said outsole opening operatively bearing on the outsole.

2. A shoe sole as defined in claim 1, in which:

(e) said outsole includes a reinforcing ring coaxial with said outsole opening and greater in size than the insert.

3. A shoe sole as defined in claim 2, in which:

(f) said reinforcing ring includes an inwardly and upwardly inclined lower face.

4. A shoe sole as defined in claim 1, in which:

(e) said insert central portion is substantially dome shaped having a dome height such that said central portion is not ground engaging under normal play conditions but engages the ground under appropriate player weight distribution conditions.

5. A shoe sole as defined in claim 4, in which:

(f) said insert includes a stepped portion adjacent said domed portion.

6. A shoe sole as defined in claim 1, in which:

(e) the insole is of pressboard and the portion of said insole above said insert axis includes a plurality of radiating slits.

7. A shoe sole as defined in claim 1, in which:

(e) the insert is of a material having superior cushioning to the midsole material.

8. A shoe sole as defined in claim 1, in which:

(e) the insert is of polyurethane.

9. A shoe sole as defined in claim 1, in which:

(e) the midsole is of EVA.

10. A shoe sole as defined in claim 1, in which:

(e) said outsole includes a first generally circular opening located under the ball of the foot and a second generally circular opening located under the heel of the foot, (f) said midsole portion includes two generally circular cavity openings each associated with an outsole opening and having a diameter greater than said associated outsole opening and being generally concentric with said outer sole opening, and (g) an insert is disposed within each cavity opening of the midsole portion, each insert having a diameter of the midsole cavity and each insert having a central portion substantially the same diameter as, and generally concentric with said associated outsole portion opening, and projecting into said opening but not beyond the outsole ground-engaging surface and having an annular portion overlapping said outsole opening and bearing on said outsole.

11. A shoe sole as defined in claim 10, in which:

(f) the insert located at the heel of the foot is substantially thicker than the insert located at the ball of the foot.

12. A shoe sole as defined in claim 10, in which:

(f) outsole openings are of substantially the same diameter as each other and the inserts are of substantially the same diameter as each other.

13. A shoe sole as defined in claim 10, in which:

(f) said outsole includes a pair of ribbed reinforcing rings each associated with, and having an outside diameter greater than the diameter of said associated insert.

14. A shoe sole comprising:

(a) an insole, (b) an outsole including a portion located at the ball of the foot and a portion located at the heel of the foot including an opening in at least one of said portions, said outsole having a ground-engaging surface, (c) a midsole cushioning portion sandwiched between said insole and said outsole and including at least one cavity opening of a size greater than the outsole opening and being generally concentric with said outsole opening, (d) an insert is disposed within the cavity opening of the midsole portion, said insert having an outer portion of a size substantially the same as the size of the midsole cavity opening, said insert having an inner central portion substantially the same size as, and generally concentric with said outsole portion opening said opening and having an annular portion overlapping said outsole opening operatively bearing on the outsole, and (e) said outsole including a reinforcing ring coaxial with said outsole opening and greater in size that the insert, and said reinforcing ring including an inwardly and upwardly inclined lower face, whereby said ring is downwardly flexible.

* * * * *